United States Patent [19]

Pulskamp

[11] Patent Number: 5,009,408

[45] Date of Patent: Apr. 23, 1991

[54] CONTINUOUS FEED BOARD INSERTER

[76] Inventor: Nicholas R. Pulskamp, 1616 Bushnell Ave., South Pasadena, Calif. 91030

[21] Appl. No.: 324,584

[22] Filed: Mar. 16, 1989

[51] Int. Cl.[5] ..... B65H 5/30

[52] U.S. Cl. ..... 270/57; 270/95; 414/927; 198/444

[58] Field of Search ..... 270/54, 55, 57, 58, 270/95; 414/927, 789.5; 198/444, 502.1, 502.3

[56] References Cited

U.S. PATENT DOCUMENTS

| | | | |
|---|---|---|---|
| 1,642,746 | 9/1927 | Renz . | |
| 1,709,004 | 4/1929 | Broadmeyer . | |
| 2,619,883 | 12/1952 | Andren . | |
| 2,621,040 | 12/1952 | Rinehart . | |
| 2,855,833 | 10/1958 | Rugg et al. . | |
| 2,927,512 | 3/1960 | Lambert . | |
| 3,149,834 | 9/1964 | Faeber . | |
| 3,249,483 | 5/1966 | Kauffman et al. . | |
| 3,458,186 | 7/1969 | Schmidt . | |
| 3,466,983 | 9/1969 | Meyer-Jagenberg . | |
| 3,555,978 | 1/1971 | McCool . | |
| 3,611,887 | 10/1971 | Shibanuma | 270/95 |
| 3,923,145 | 12/1975 | Muller . | |
| 3,966,196 | 6/1976 | Simeth . | |
| 3,979,112 | 9/1976 | Munn et al. . | |
| 4,151,986 | 5/1979 | Kawada | 270/95 |
| 4,210,067 | 7/1980 | Evans, Jr. . | |
| 4,436,472 | 3/1984 | Kunzmann . | |
| 4,565,130 | 1/1986 | Leu . | |
| 4,624,452 | 11/1986 | Pulskamp . | |
| 4,772,003 | 9/1988 | Nobuta et al. . | |

FOREIGN PATENT DOCUMENTS

| | | |
|---|---|---|
| 778307 | 1/1972 | Belgium . |
| 978398 | 12/1964 | United Kingdom . |

OTHER PUBLICATIONS

Specification for Automation Cardboard Feeder, No. 1283226.

*Primary Examiner*—John T. Kwon
*Assistant Examiner*—Therese M. Newholm
*Attorney, Agent, or Firm*—Christie, Parker & Hale

[57] ABSTRACT

A board inserter for use with a conveyor belt system provides for the automatic insertion of paper boards, or like materials, into a continuous stream of shingled paper sheets moving along the conveyor belt system. The boards are inserted into the shingled paper stream without disrupting the flow of the stream.

20 Claims, 3 Drawing Sheets

CONTINUOUS FEED BOARD INSERTER

FIELD OF THE INVENTION

This invention relates to an apparatus and method for injecting paper boards into a stream of paper sheets, and more specifically, to an apparatus and method for automatically inserting paper boards, or like materials, at intervals into a moving stream of shingled paper sheets without interrupting the flow of the sheets.

BACKGROUND OF THE INVENTION

In the manufacture of note pads, drawing pads, or similar materials, it is common in forming the pad to accumulate paper sheets in a stack and periodically insert paper boards into the stack. The paper boards serve as backing to each pad from the stack. Each backing board can then be cemented at one edge to the sheets above it to produce each pad.

Typically, paper sheets are added to the stack one at a time as they exit a printing press or after they are delivered and cut from a web. The backing boards are typically added either as the individual sheets fall onto the stack, or as the sheets are transported to the stack on a conveyor system.

For example, Pulskamp U.S. Pat. No. 4,624,452, the inventor herein, describes a mechanism that periodically injects paper boards onto a stack of paper sheets as the sheets fall one at a time from a printing press onto the stack. Broadmeyer U.S. Pat. No. 1,709,004 and Munn U.S. Pat. No. 3,979,112 disclose mechanisms which periodically add paper boards, or like material, onto a conveyor which is used to transport individual paper sheets in an end-to-end fashion. The sheets and boards are ultimately deposited on a stack thus producing a pile of paper sheets with backing boards interleaved at predetermined intervals. While these apparatus are fairly effective for the applications disclosed, they are limited by the fact that the paper sheets are transported along a conveyor in an end-to-end fashion or otherwise delivered to the stack one at a time.

Often, instead of being configured end-to-end, paper sheets are transported on a conveyor system in a shingled or overlapping manner. This particular configuration renders the above referenced art inadequate as merely placing a board on the stream of papers will fail to integrate that board into the paper stack. Instead, the paper boards must somehow be shuffled into the stream of shingled sheets, or alternatively, the stream of sheets must be interrupted to allow the addition of the board into the stream.

Faeber U.S. Pat. No. 3,149,834 discloses a method for interrupting a stream of sheets moving along a conveyor. In this method, the stream is "pinched" at a particular point so that certain sheets within the stream are held in place while allowing the sheets immediately in front of the pinched sheets to continue moving along the conveyor system. This in turn creates a gap in the stream after the pinched sheets are released. Although not disclosed in the Faeber patent, cardboard backing material could be added to the paper stream at this point for later deposit into a stack. A drawback to this particular method is that paper sheets bunch up behind the pinched portion of the stream increasing the likelihood of a jam or similar problem.

Additionally, these conventional methods require mechanisms that are typically dedicated to whatever conveyor system is already in use. These mechanisms, even standing alone, can be expensive. To the extent that the above referenced methods can be added as attachments to an existing conveyor system, complicated and expensive adaptations may be required.

SUMMARY OF THE INVENTION

The present invention is directed to an apparatus and method for automatically inserting paper boards, or like materials, into a stream of shingled paper sheets moving along a system of moving belts. A secondary conveyor is used to lift the paper stream off of the primary belt system and to provide continued forward movement for the paper stream. Once the paper stream has been lifted above the primary belt system, the secondary conveyor ends abruptly allowing the sheets in the paper stream to fall back down to the primary belt system. A retaining mechanism is extendible into the path of the falling sheets to inhibit the downward movement of the trailing edges of the paper sheets. Concurrently, a path clearing mechanism encourages the trailing edges of those sheets not detained by the retaining mechanism down against the primary belt system. The retaining and path clearing mechanisms create a momentary gap in the shingled stream of sheets into which a board is inserted.

BRIEF DESCRIPTION OF THE DRAWINGS

The above and other features and advantages of the present invention will become apparent from the following detailed description and accompanying drawings forming part of this application wherein.

DETAILED DESCRIPTION

Figure 1:
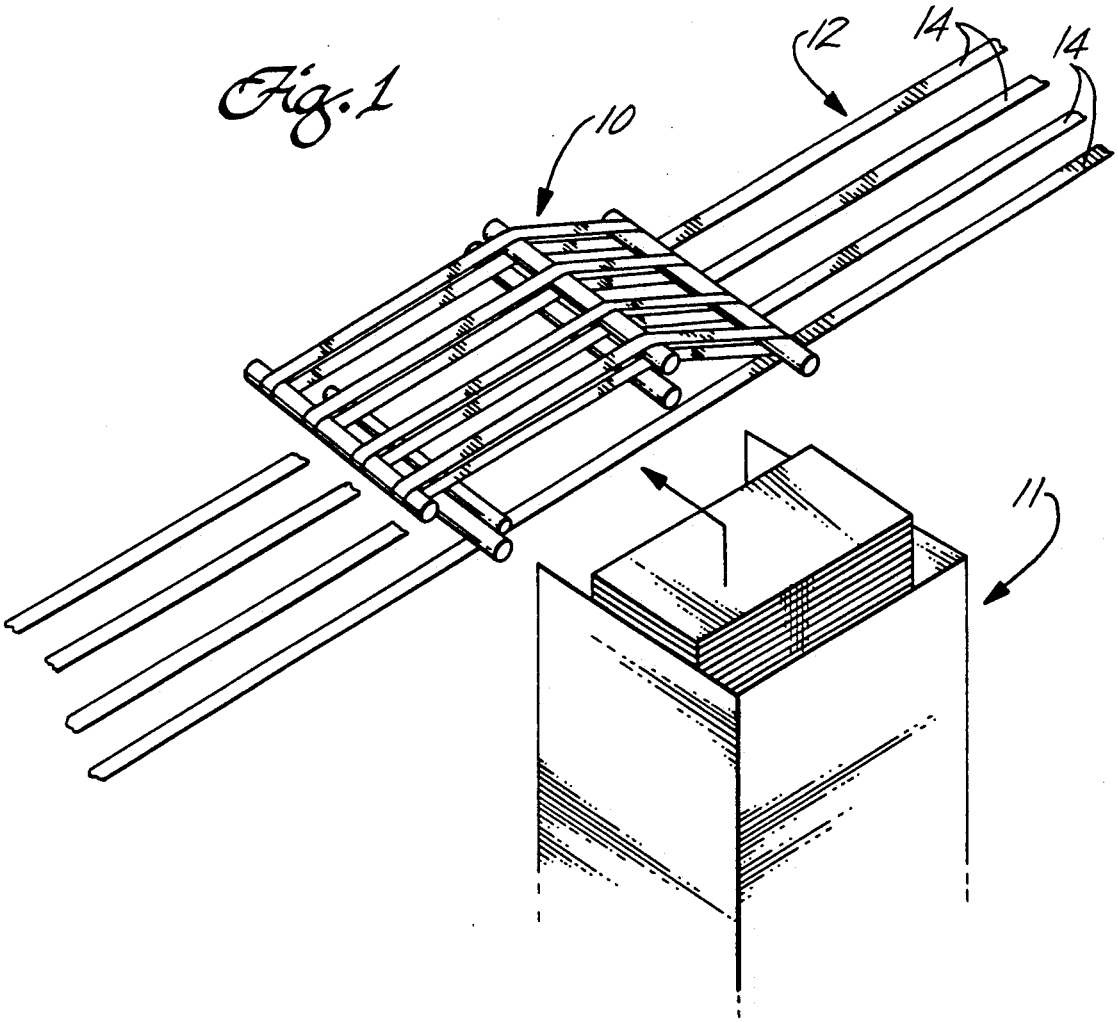
FIG. 1 is a schematic perspective view of the present invention shown in operative relationship to an existing conveyor belt system.
Figure 3:
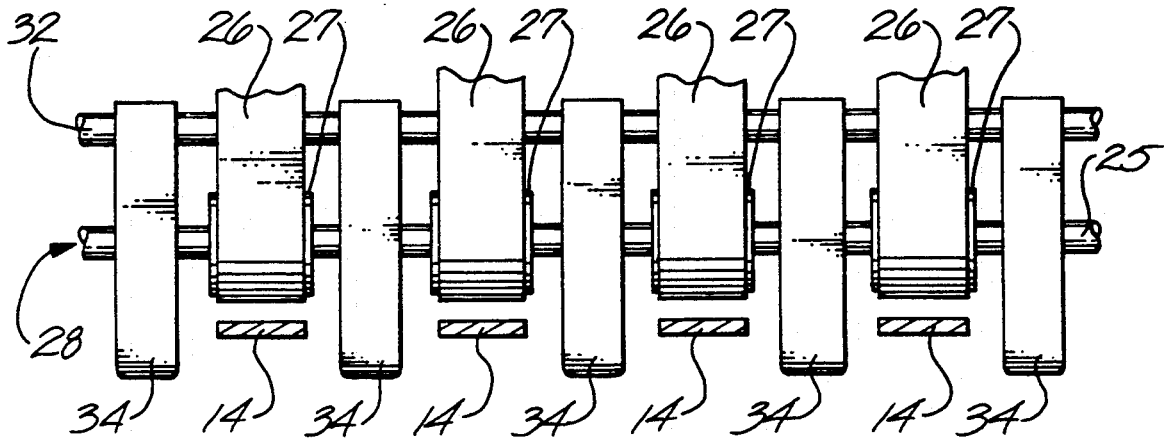
FIG. 3 is a view partly in elevation and partly in cross-section of the relationship between the leading edge of the conveyor system as configured in the preferred embodiment of the present invention and the existing conveyor belt system.

The presently preferred embodiment of the invention is indicated generally at 10 in FIG. 1 in operative relationship with the typical conveyor system 12. This conveyor system, which will be designated as the primary conveyor system, is of conventional design and comprises four parallel loop belts 14, which together create a continuously moving platform. A typical belt design has belts that are one inch wide, one eighth to one quarter inch thick and spaced one and one half inches from each other. FIGS. 1, 2, 4 and 5 should be viewed with the understanding that the primary conveyor system is moving from right to left. Each of the belts has a rectangular cross-sectional shape, as shown in FIG. 3, and can be made from any suitable material that will cause a frictional coupling with paper. The primary conveyor system is used to transport paper sheets from one point to another.

Figure 5:
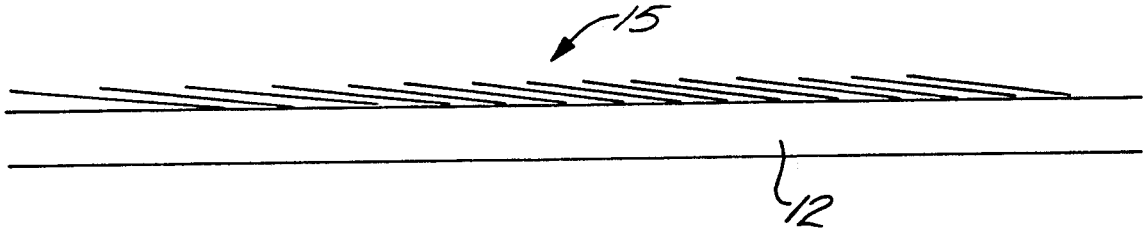
FIG. 5 is an expanded side elevational view of the configuration of the shingled stream of paper sheets as it is positioned on the conveyor belt system.

Throughout this specification, any reference to the leading edge of a paper sheet should be understood as referring to that edge which faces the direction of movement of the stream of paper sheets, the trailing edge of a sheet is that edge which is exactly opposite the leading edge, and the side edges of a paper sheet are the two remaining edges. The sheets rest on the moving conveyors in an interleaved or shingled fashion, as shown in FIG. 5, such that the leading and trailing edges of each sheet overlaps the leading and trailing edges of adjacent sheets, as the side edges remain in alignment.

Figure 2:
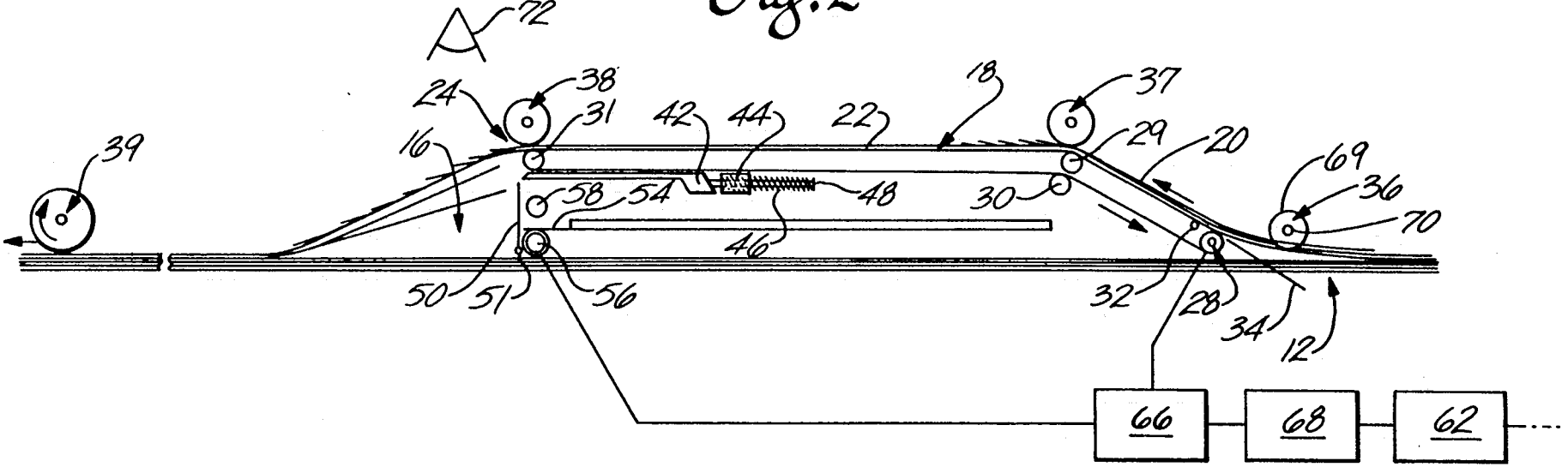
FIG. 2 is a schematic side elevational view of the present invention shown in relationship to an existing conveyor belt system.

The present invention operates by providing a detour for the stream of shingled sheets from the primary conveyor system, and as a result, cardboard sheets can easily be inserted into the stream. FIG. 2 shows how the path of the sheet stream is altered by the present invention. Generally, as the sheets move along the primary conveyor system 12, in a forward direction, they are diverted onto a secondary conveyor system 18. The paper stream is then lifted above the primary conveyor system 12 along upwardly sloped portion 20 of the secondary conveyor system, and then along the horizontal portion 22 of the secondary conveyor system while continuing in a forward direction.

When the paper sheets reach the forward edge 24 of the platform created by the secondary conveyor system, they fall from the secondary conveyor system back down to the primary belts 14 through the area generally indicated a 16. As shown in FIG. 2, the leading edges of the sheets tend to fall to the belt first from the weight of the leading edges of the sheets following in the stream. However, the trailing edges of the sheets fan out and fall to the primary belt separately. The integrity of the stream of sheets is maintained throughout the process.

For further insight into this diversion process, the technique and embodying apparatus will be examined in more detail. The secondary conveyor system 18 is comprised of four separate continuous loop belts 26, which are routed over four cylindrical rollers 28, 29, 30 and 31 to form the moving platform as described in the previous paragraph. These secondary belts 26 are positioned in alignment with the belts 14 which comprise the primary conveyor system as shown in FIG. 3. At least one of the rollers is coupled to a power means to rotate the secondary conveyor system which provides continuous forward movement for the paper stream after it is diverted from the primary conveyor system.

Figure 4:
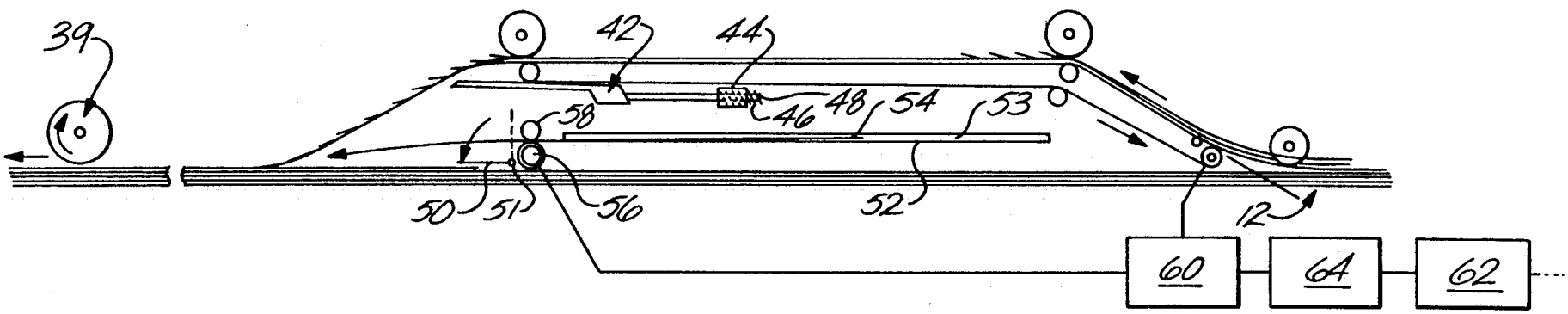
FIG. 4 is a schematic side elevational view, as shown in FIG. 2, of the present invention in operation.

It is presently preferred to have the secondary conveyor system powered by a separate power means 60 from the primary power means 62 driving the primary conveyor system so that the present invention can form a self-contained unit that can be dropped into place over any length of conveyor carrying paper sheets where room is available. For example, the operative elements of the present invention could be positioned in a console or module rotatably supported along one edge to a portable support table that could be moved into place alongside the primary conveyor system. The console could then be rotated down to position the present invention for operation and rotated up when not in use. An electronic tachometer 64 or similar device could then be used to match the speed of the secondary conveyor system to that of the primary conveyor system (FIG. 4). Alternatively, a drive mechanism 66 could be coupled to the primary conveyor system with the proper gear interface 68 so that both conveyor systems would use a common power means (FIG. 2).

Roller 28 is comprised of a cylindrical support shaft 25 on which four cylindrical wheels 27, FIG. 3 are mounted to engage the belts 26 of the secondary conveyor system. The construction of the remaining rollers 29, 30 and 31 is not critical. They may be configured similarly to roller 28 or in any other configuration that will create the moving platform as described.

The secondary belts are positioned above and adjacent to the primary belts at roller 28. This positioning facilitates diversion of the paper stream onto the secondary conveyor system. This transfer is further facilitated by five scoops 34 and a skid wheel 36. As shown in FIG. 3, three of the scoops are positioned in the spaces between the aligned sets of primary and secondary belts and the remaining two outer scoops are positioned just outside the outer belts on each side of the conveyor systems. The two outer scoops are provided to ensure that the side edges of the paper sheets do not droop but instead are transferred squarely to the secondary conveyor system.

The scoops are mounted on a spring-loaded shaft 32 such that they create an extension from the sloped portion 20 of the secondary conveyor system down to the primary belts (as seen in FIG. 2). The scoops extend down past belts 14 so that their lower edges contact the table (not shown) under belts 14 to create a sturdy ramp to guide the paper sheets. Shaft 32 is spring-loaded to facilitate the fit of the scoops to a given belt support table. The function of the scoops is to bridge the gap between the primary and secondary belts. When the paper sheets in the stream reach this junction, they are guided upward along the scoops until they meet the secondary belts, at which time, they become coupled to the secondary belts by friction. The scoops are constructed from any suitable material that is relatively smooth to avoid jamming the stream.

The skid wheel 36 is comprised of a number of wheels 69 or rollers mounted upon and freely rotatable around a cylindrical support axle 70. The circumferential surface of the wheels are knurled, rubber or of some other suitable design to maintain a light frictional coupling with the paper stream. The wheels are rotated solely by their contact with the paper stream but should not create an excessive drag on the paper stream. The wheels are adjustable axially along the length of axle 70 so that they can be spaced to avoid contacting the wet ink on freshly printed paper sheets. The main function of this skid wheel is to maintain the alignment and integrity of the paper stream as it makes the transition from the primary conveyor system to the secondary conveyor system. It does so by restraining any lateral or sideways movement of sheets within the stream, as their leading edges come in contact with the scoops.

Following the paper stream up the slope portion of the secondary conveyor system, the stream reaches an elbow at roller 29, from which point, the secondary belts continue in a horizontal configuration. Resting above the secondary belts, adjacent to roller 29, is a skid wheel 37 configured in substantially the same way as skid wheel 36. The function of this second skid wheel is to maintain the integrity of the paper stream as it moves on the belts and changes direction over roller 29.

The paper stream continues horizontally along the secondary conveyor system until it reaches roller 31, at which point, the moving platform created by the belts comes to an end at a point spaced apart from the primary conveyor system as the secondary belts turn back on themselves. Resting above the secondary belts, adjacent to the roller 31, is a skid wheel 38 having a configuration that is substantially the same as skid wheels 36 and 37. The function of this third skid wheel is to maintain the integrity of the paper stream and to direct the path of the sheets within the stream as they begin to fall down to the primary conveyor system. After the paper stream falls back to the primary conveyor system, it is engaged by another skid wheel 39 having the same configuration as the other skid wheels. The function of skid wheel 39 will be addressed below.

Paper boards are intermittently inserted into the paper stream as the sheets fall from the secondary conveyor system to the primary conveyor system. To determine when a paper board should be inserted, a counter 72 is provided above and alongside the area generally indicated at 16 to count paper sheets. After a predetermined number of paper sheets have been counted, as appropriate for the pads being made, the counter transmits a signal to initiate the board insertion apparatus. It should be understood that the counter can be any of a number of different types well known in the art. Also, the counter could be replaced by a timer that would trigger board insertion at periodic time intervals for certain applications.

The apparatus used to accomplish board insertion is positioned below the secondary conveyor system and is spaced immediately above the primary conveyor system, as shown in FIG. 2 and FIG. 4. Retaining arms 42 are positioned side by side slightly underneath the horizontal portion of the secondary conveyor system, i.e., just below the secondary belts as they travel between roller 31 and roller 30. The rear of each retaining arm is coupled to a solenoid actuated assembly 44, which engages the retaining arm and forces it into the path of the falling sheets. Each retaining arm is further coupled to a spring 46, which compresses when the arm is extended into the path of the stream. When the solenoid driven assembly releases the retaining arm, the spring decompresses thereby forcing the retaining arm to spring back to its original position.

When a cardboard sheet is to be inserted into the paper stream, the solenoids are actuated in unison and the retaining arms are momentarily moved into the path of the falling sheets. The retaining arms only extend so far as to enter the path of the trailing edges of the paper sheets and momentarily delay the descent of the trailing edges. A number of retaining arms are used to ensure that the trailing edge of the paper sheets is held up across the entire width of the paper sheet. This avoids the possibility of part of the trailing edge drooping down and blocking the path of a paper board during insertion. Preferably, enough retaining arms are used to have them spaced one inch apart. At least four retaining arms should be used for paper eight and one half inches in width. It should be understood that a single solenoid mechanism could be used to actuate a retaining arm with several branches at the front.

It should also be understood that the solenoid actuating means is merely an example of one way by which retaining arms 42 can be extended. Any means for extending the retaining arms that is able to extend and retract them quickly for momentarily detaining the trailing edges of paper sheets could be used.

Concurrently, a path clearer 50, which is normally in an upright position just below the leading edge of the retaining arms in their retracted position, pivots around point 51 located just above the primary belts and swings down and out to a horizontal position (FIG. 4). In so doing, it forces the trailing edges of those falling sheets which were not detained by the retaining arms down toward the primary conveyor system, thus creating a gap in the trailing edges of the sheets between the retaining arms and the horizontal path clearer.

It is this gap into which a cardboard sheet can be inserted. This is accomplished with the use of two rollers, a driver roller 56 and an idler roller 58. The cardboard to be inserted rests on a platform 52 located between the horizontal portion of the secondary conveyor system and the primary belts below the retaining arm assembly and above pivot point 51.

Each cardboard sheet 54 is loaded into the platform from the side by a loader 11 (shown in FIG. 1). This cardboard loader is of conventional design well known in the art for front end loading of items into a paper path at the beginning of a process and adapted for side loading. The cardboard sheet is positioned on the platform such that its leading edge rests just above the drive roller 56. A side wall 53 extending up from the edge of platform 52 along the side opposite loader 11 ensures that the cardboard sheet fed onto the platform will be aligned with the paper stream. It should be understood that other devices, guides or mechanisms can be used to align the cardboard sheet with the paper stream as well.

The cardboard sheet is ejected into the paper stream when the idler roller 58 drops and pinches the cardboard sheet between the idler roller and the drive roller. The circumference of the drive roller is knurled or covered with a suitable material such that, when the cardboard sheet is pinched against it, the friction between it and the drive roller will cause the sheet to move in a forward direction (from right to left in FIG. 4).

The skid wheel 39 is positioned downstream and above the primary belts to limit the distance a board will be inserted into the paper stream. If a board travels too far, it will no longer be integrated with the paper stream. The force with which a board is ejected is also controlled to prevent the board from travelling too far. However, the board must be inserted quickly to minimize the disruption to the paper stream caused by extending the retaining arm. The effectiveness of the above described ejection apparatus comprised of the drive roller and the idler .roller is maximized when the drive roller accelerates the cardboard sheet to a velocity equal to two to three times the velocity of the paper stream. Skid wheel 39 also acts to maintain the integrity of the paper stream as boards are inserted.

As with the power means for the secondary belt system, it is presently preferred to have a separate power means 60 for drive roller 56 and use an electronic tachometer 64 or similar device to ensure that cardboard is ejected at a velocity between two to three times the velocity of the paper stream (FIG. 4). However, the drive roller could also be coupled to the primary conveyor system with the proper gear interface (FIG. 2).

Figure 6:
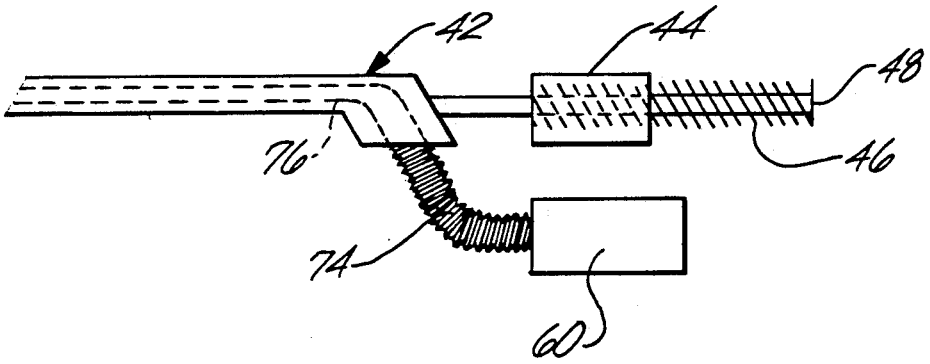
FIG. 6 is a schematic side elevational view of an alternative embodiment of the present invention incorporating a blower to displace the falling sheets.

The preceding description has been presented with reference to a presently preferred embodiment to the invention shown in the accompanying drawings. Workers skilled in the art to which this invention pertains will appreciate that alterations and changes in the described structures can be practiced without departing from the spirit, principles and scope of this invention. For example, the actions of retaining arms 42 and path clearer 50 could both be accomplished by a blower 60 (FIG. 6)

that momentarily directs pressurized air through a series of flexible tubes 74 to a hollow passageway 76 in each of the retaining arms. The pressurized air then exits the tip of each retaining arm when it is extended between the trailing edges of two sheets of paper to form the gap into which the cardboard is inserted.

Accordingly, the foregoing description should not be read as pertaining only to the structure described, but rather, should be read consistent with and as support for the following claims which are to have their fullest fair scope.

What is claimed is:

1. An apparatus for injecting paper boards and like material into a continuous stream of interleaved paper sheets moving in a forward direction along a primary conveyance means, comprising:

means for lifting the paper stream from the primary conveyance means, the means for lifting providing continued forward movement and subsequently allowing the papers in the stream to fall back onto the primary conveyance means;

retaining means extendible into the path of the falling paper sheets to momentarily detain the trailing edges of the sheets from downward movement;

path clearing means for moving the trailing edges of the falling sheets not detained by the restraining means toward the primary conveyance means;

ejection means for feeding a paper board or like material into the space cleared in the falling sheets by the retaining means and the path clearing means and thus into the moving stream of papers.

2. An apparatus according to claim 1 wherein the means for lifting defines a moving platform for receiving the paper stream from the primary conveyance means and having a shape such that the receiving end of the platform is adjacent to the primary conveyance means to facilitate the removal of the paper stream from the primary conveyance means, the opposite end of the platform extending above the primary conveyance means to allow the papers in the shingled stream to fall from the platform to the primary conveyance means.

3. An apparatus according to claim 1 further comprising limiting means for limiting the distance which the ejected board travels through the paper stream.

4. An apparatus according to claim 3 wherein the limiting means is at least one rotatable wheel frictionally coupled to the paper stream and positioned above the primary conveyance means.

5. An apparatus according to claim 1 wherein the ejection means is comprised of a drive roller and an idler roller, the drive roller rotating at a speed sufficient to accelerate the board to a velocity corresponding at least to that at which the paper stream is moving, the idler roller positioned adjacent to the drive roller and being movable into a position to pinch the board between it and the drive roller thus causing the board to accelerate to the appropriate velocity.

6. An apparatus according to claim 5 wherein the drive roller is circumferentially knurled to cause a frictional coupling with the board when the board is pinched between the drive roller and the idler roller.

7. An apparatus according to claim 5 wherein the drive roller is rotating at a speed sufficient to eject the board at a velocity of between about two to about three times that of the paper stream.

8. An apparatus according to claim 1 further comprising synchronizing means to synchronize the speed of the means for lifting to that of the paper sheets moving along the primary conveyance means.

9. An apparatus according to claim 8 wherein the synchronizing means comprises an electronic tachometer.

10. An apparatus according to claim 8 wherein the synchronizing means comprises a mechanical gear assembly coupling the means for lifting and the primary conveyance means moving the paper sheets along the primary path.

11. An apparatus according to claim 1 wherein the retaining means comprises a substantially rigid elongated member coupled to a solenoid actuator to extend the member into the path of the falling paper sheets.

12. An apparatus according to claim 11 wherein the retaining means further comprises a spring coupled to the elongated member to return the elongated member to its original position.

13. An apparatus according to claim 1 wherein the path clearing means is comprised of a substantially rigid elongated member adapted for pivotal movement between a vertical and a horizontal position.

14. An apparatus for injecting paper boards and the like material into a stream of interleaved paper sheets moving along a primary conveyance means, comprising:

means for upwardly diverting the paper stream from the primary conveyance means, and subsequently allowing the papers in the stream to fall to the primary conveyance means;

separation means for creating a gap in the trailing edges of the sheets as they fall; and ejection means for positively inserting the paper boards or like material into the gap in the paper stream formed by the separation means.

15. An apparatus according to claim 14 wherein the separation means is pneumatically actuated.

16. An apparatus according to claim 14 adapted to modularly drop down onto an existing conveyor system.

17. A method for injecting paper board and like material into a continuous stream of interleaved paper sheets moving in a forward direction on a primary conveyance means comprising the steps of:

raising the stream above the primary conveyance means;

dropping the stream back onto the primary conveyance means;

forcing a gap in the trailing edges of the sheets as they fall back to the primary conveyance means; and injecting a paper board positively into the gap.

18. A method for placing paper boards into a continuous stream of shingled paper sheets moving along a primary conveyance means comprising the steps of:

lifting the sheets in the paper stream from the primary conveyance means while maintaining the forward movement and configuration of the stream;

dropping the sheets back onto the primary conveyance means;

impeding the downward path of the trailing edges of the paper sheets;

forcing the downward movement of the trailing edges of sheets not impeded, thus creating a gap in the downward flow of the trailing edges of sheets; and injecting a paper board positively into the stream of paper sheets at the gap.

19. An apparatus for injecting paper boards and the like material into a stream of interleaved paper sheets moving along a primary conveyance means, comprising:

means for diverting the paper stream from the primary conveyance means, and allowing the papers in the stream to fall so that the trailing edges of the sheets fan out;

separation means for creating a gap between trailing edges of a pair of selected sheets as they fall; and ejection means for positively inserting the paper boards or like material into the gap in the paper stream formed by the separation means.

20. A method for injecting paper boards and the like material into a stream of interleaved paper sheets moving along a primary conveyance means, comprising the steps of:

diverting the paper stream from the primary conveyance means, and allowing the papers in the stream to fall so that the trailing edges of the sheets fan out;

creating a gap between trailing edges of a pair of selected sheets as they fall; and positively inserting the paper boards or like material into the gap in the paper stream formed by the separation means.

* * * * *